US006227170B1

(12) United States Patent
Koshiba

(10) Patent No.: US 6,227,170 B1
(45) Date of Patent: May 8, 2001

(54) ENGINE FUEL RAIL AND METHOD OF FABRICATING SAME

(75) Inventor: Kiyofumi Koshiba, Toyama-ken (JP)

(73) Assignee: Kojin, Ltd., Toyama-ken (JP)

( * ) Notice: Subject to any disclaimer, the term of this patent is extended or adjusted under 35 U.S.C. 154(b) by 0 days.

(21) Appl. No.: 09/407,180

(22) Filed: Sep. 29, 1999

(51) Int. Cl.[7] ..... F02M 41/00; F02M 55/02
(52) U.S. Cl. ..... 123/456; 123/468
(58) Field of Search ..... 123/456, 468, 123/469, 470, 472; 239/550, 585, 88–92; 137/870

(56) References Cited

U.S. PATENT DOCUMENTS

| | | | | |
|---|---|---|---|---|
| 4,570,601 | * | 2/1986 | Ito et al. | 123/468 |
| 5,339,786 | * | 8/1994 | Martin | 123/467 |
| 5,390,638 | * | 2/1995 | Hornby et al. | 123/456 |
| 5,616,037 | * | 4/1997 | Lorraine et al. | 439/130 |

OTHER PUBLICATIONS

Der neue Zwölfzylinder–Motor fur die neue Mercedes–Benz S–Klasse Teil 2, *Motortechnische Zeitschrift* 52 (1991), pp. 220–232. (German language article.)

* cited by examiner

*Primary Examiner*—Henry C. Yuen
*Assistant Examiner*—Mahmoud Gimie
(74) *Attorney, Agent, or Firm*—Flynn, Thiel, Boutell & Tanis, P.C.

(57) ABSTRACT

The invention provides an engine fuel rail compact and having highly reliable functions because it is an insert-molded product integral with an electrical wiring, contributing to reduction in the number of fabrication steps and cost of fabrication, and a method of fabricating the same. An oil delivery path and the electrical wiring in parallel therewith are embedded in a base member molded from a synthetic resin, as a main body, so as to be integral with each other, and a plurality of branching blocks for respective cylinders of an engine are provided protuberantly on the right side and the left side of the base member, alternately, the base member having an opening at one end thereof to serve as a socket on an input side for the electrical wiring, while the end face of respective branching blocks has an opening to serve as a fixture mount for respective injectors and an opening to serve as a socket on an output side for connection of the respective injectors with the electrical wiring. Thus, the engine fuel rail of the invention can be fabricated as a component at a low cost because it is an insert-molded product integral with the electrical wiring and the cord can be omitted. Further, it can be provided as a highly reliable product capable of withstanding severe ambient conditions existing inside an engine room in addition to having suitability for saving of labor in application due to reduction in the number of fabrication steps, and capability of rendering the product lighter in weight and compact.

11 Claims, 3 Drawing Sheets

ENGINE FUEL RAIL AND METHOD OF FABRICATING SAME

BACKGROUND OF THE INVENTION

1. Field of the Invention

The present invention relates to a fuel rail (also called a fuel gallery or fuel distributor) fitted to an engine of an automobile and the like for delivering gasoline or the like to the engine through distribution among respective cylinders thereof.

2. Description of the Related Art

The fuel rail is one of primary components among products for a fuel injection system for use in the middle between a fuel tank and the engine, and as such, pressure tightness, airtightness (leak-proof), and oil tightness are strictly required of it owing to needs of ensuring that it has a function of stably delivering a combustible such as gasoline or the like.

A conventional fuel rail has a construction, wherein a fuel pipe is provided with a plurality of openings to serve as a fixture mount for respective injectors in dedicated use for respective cylinders of an engine and integrally formed mainly of aluminum by die casting, and an electrical wiring insert-molded in a covering made of synthetic resin which is used for activating respective injectors is attached to a side of the fuel pipe separately for connection therewith. The electrical wiring insert-molded in the covering made of synthetic resin is used for driving a solenoid valve of the respective injectors, and a cord fitted with a female connector is drawn out up to the tip thereof while a male connector is fitted to the respective injectors protuberantly.

With the conventional fuel rail described above, the electrical wiring insert-molded in the covering made of synthetic resin is disposed so as to be used in parallel therewith, and this configuration not only has taken much space of an engine room but also has required additional steps in an assembling process, resulting in a higher cost of fabrication.

The electrical wiring insert-molded in the covering made of synthetic resin is formed by embedding an electrical wiring into the covering made of synthetic resin by means of insert-molding, but it is susceptible to the effect of severe ambient conditions existing inside an engine room due to the fact that the covering can not be expected to have a sufficient thickness in view of economics and needs for weight reduction, and a cord is used for connection thereof with the respective injectors, thus posing uncertain factors for occurrence of troubles such as a faulty motion caused to occur in activation of the injectors.

Similarly, the thickness of the fuel rail itself is under constraints, and this also has posed a problem with reliability thereof in respect of pressure tightness, airtightness (leak-proof), and oil tightness as described in the foregoing.

SUMMARY OF THE INVENTION

In light of the circumstances described above, the present invention has been developed, and an object of the invention is to provide a method of fabricating an engine fuel rail, compact and having highly reliable functions, wherein the number of fabrication steps as well as a cost of fabrication can be reduced because it is a component molded integrally with electrical wiring by means of the insert molding, and.

To achieve the above object, the method of fabricating an engine fuel rail comprises the steps of integrally molding a fuel delivery pipe from a synthetic resin, provided with a plurality of openings to serve as a fixture mount for respective injectors, said openings being branched from a fuel delivery path, assembling an electrical wiring formed of a plurality of wiring members which are securely held with a plurality of blocks by insert molding of the synthetic resin, insert setting the fuel delivery pipe and the electrical wiring in a mold, molding the fuel delivery pipe and the blocks by means of a primary molding, and molding the fuel delivery pipe integrally with the electrical wiring in a base member of the engine fuel rail, molded from the synthetic resin, by means of a secondary molding. The base member is provided with an opening at one end thereof to serve as a socket on an input side for the electrical wiring, and is also provided with a plurality of branching blocks formed integrally therewith at the side thereof, each having both an opening to serve as the fixture mount for the respective injectors and an opening to serve as a socket on an output side for the electrical wiring.

With the configuration described above, since the second molding is applied to the base member while the fuel delivery pipe and the electric wiring formed by the primary molding serve as an insert-molded product, the fuel rail has a high strength with high security because of a double structure formed by the fuel delivery pipe of the primary molding and base member of the secondary molding. Accordingly, even if the base member is formed to have a thin thickness or the electric wiring approaches the fuel delivery path for rendering the fuel rail compact, it is possible to secure safety without leakage of fuel owing to the strength of the fuel delivery pipe.

In accordance with a first aspect of the invention, there is included a case of molding the oil delivery path without executing the primary molding described above, that is, a case of molding the oil delivery path in the secondary molding. Particularly, the plurality of wiring members, which are integrally connected with one another by connection ribs, are formed at the same time when applying press working to a metal sheet in the step of assembling the electrical wiring, and the connection ribs are removed after the blocks for fixing the wiring members with one another are molded, so that the assembly of the electrical wiring for properly arranging the wiring members is made with ease.

Thus, the engine fuel rail of the invention has advantageous effects such as not only rendering the product lighter in weight and compact because of the insert setting of the fuel delivery pipe and the electrical wiring which serve as a primary molded product and are disposed rationally so as to be close to each other, and a rational thickness of the base member as a secondary molding by the insert-molding in the case that it is an insert-molded product integral with the electrical wiring, but also preventing fuel leakage with assurance and providing the engine fuel rail as a product highly reliable that can withstand severe ambient conditions existing inside an engine room and can be fabricared with ease.

DESCRIPTION OF THE PREFERRED EMBODIMENTS

Now, embodiments of the invention are described hereinafter with reference to the accompanying drawings.

Figure 4:
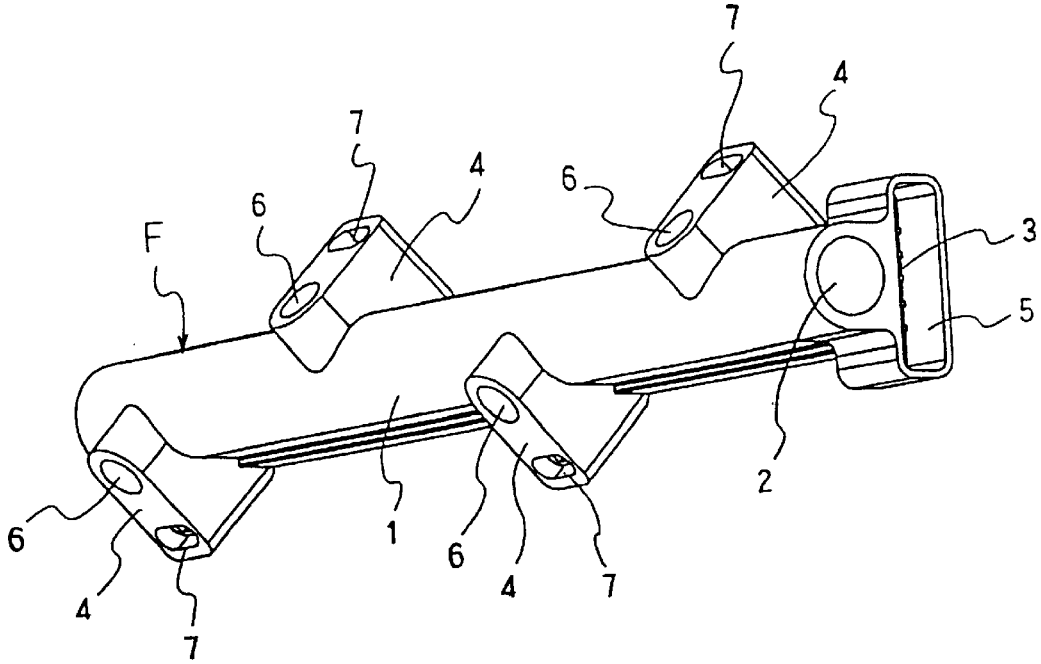
FIG. 4 is a perspective view of the engine fuel rail according to the invention as a finished product.
Figure 5:
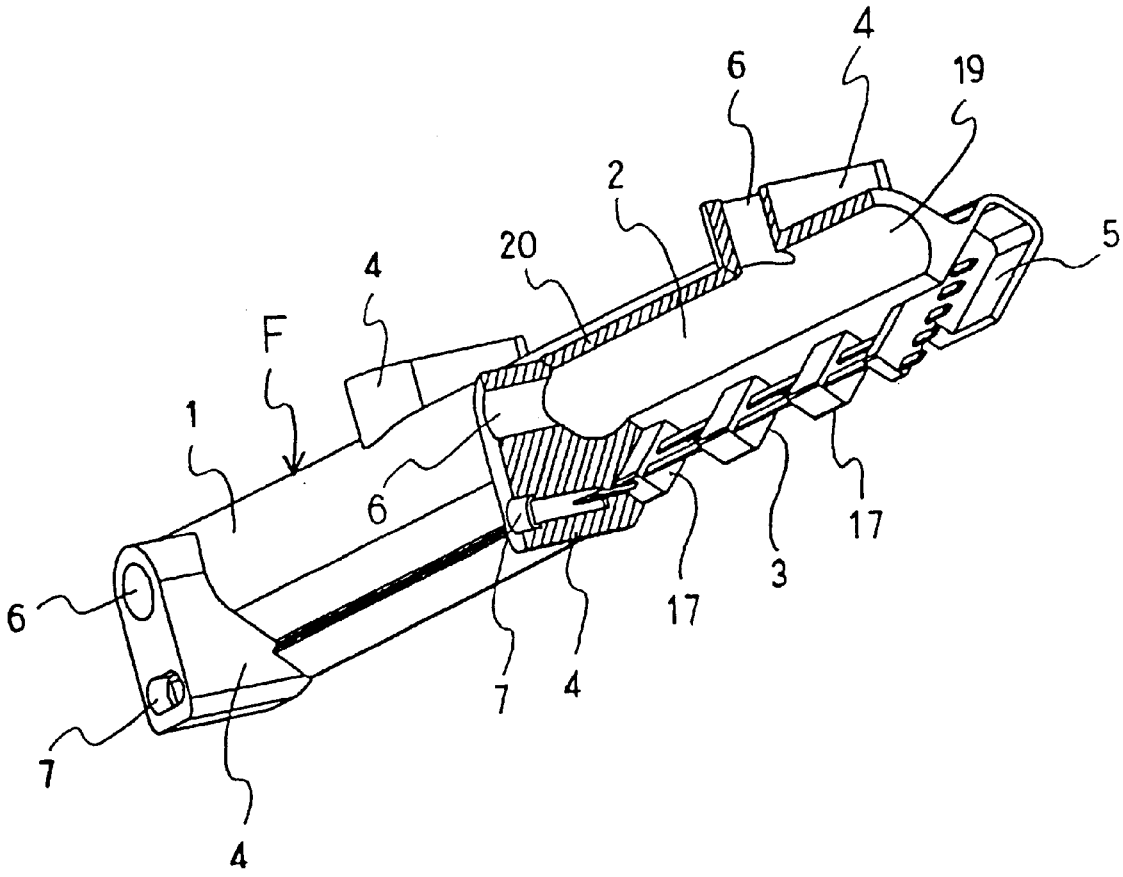
FIG. 5 is a partly cutaway perspective view of the engine fuel rail according to the invention described above.

These drawings show an embodiment of the invention, and as shown in FIGS. 4 and 5, a fuel rail according to the embodiment comprises a base member 1 made of a synthetic resin, molded in the form of a rod long from side to side, as a main body, wherein an oil/fuel delivery path 2 is formed between opposite ends thereof, and an electrical wiring 3 is embedded therein, and four branching blocks 4 dedicated for four cylinders are provided protuberantly on the right side and the left side thereof, alternately, in a staggered arrangement in the case of a 4-cylindered engine. Further, the base member 1 has an opening at one end thereof to serve as a socket 5 on an input side for the electrical wiring 3, and the end face of respective branching blocks 4 has both an opening to serve as a fixture mount 6 for respective injectors (not shown) and an opening to serve as a socket 7 on an output side for the electrical wiring 3.

The construction of the fuel rail is described in more detail hereinafter in the order of steps of fabricating the same, and a similar construction will be applicable to the case of a 6-cylindered engine.

The electrical wiring 3 is formed by pressing a copper sheet into a wiring configuration so as to regularly activate a solenoid valve of four injectors, respectively, and the wiring is arranged such that a length of electrical or wiring member 11 among five lengths of electrical wires, parallel with each other, has positive polarity while the other four lengths of electrical wires 12 have negative polarity. Further, one end of any of the lengths of electrical wires or wiring member 11, 12 is projected inside the socket 5 on the input side as an input terminal, and output terminals 11*a* and 12*a* of the lengths of electrical wires or wiring member 11, 12, respectively, with positive polarity and negative polarity, respectively, are projected inside the respective sockets 7 on the output side.

Figure 1:
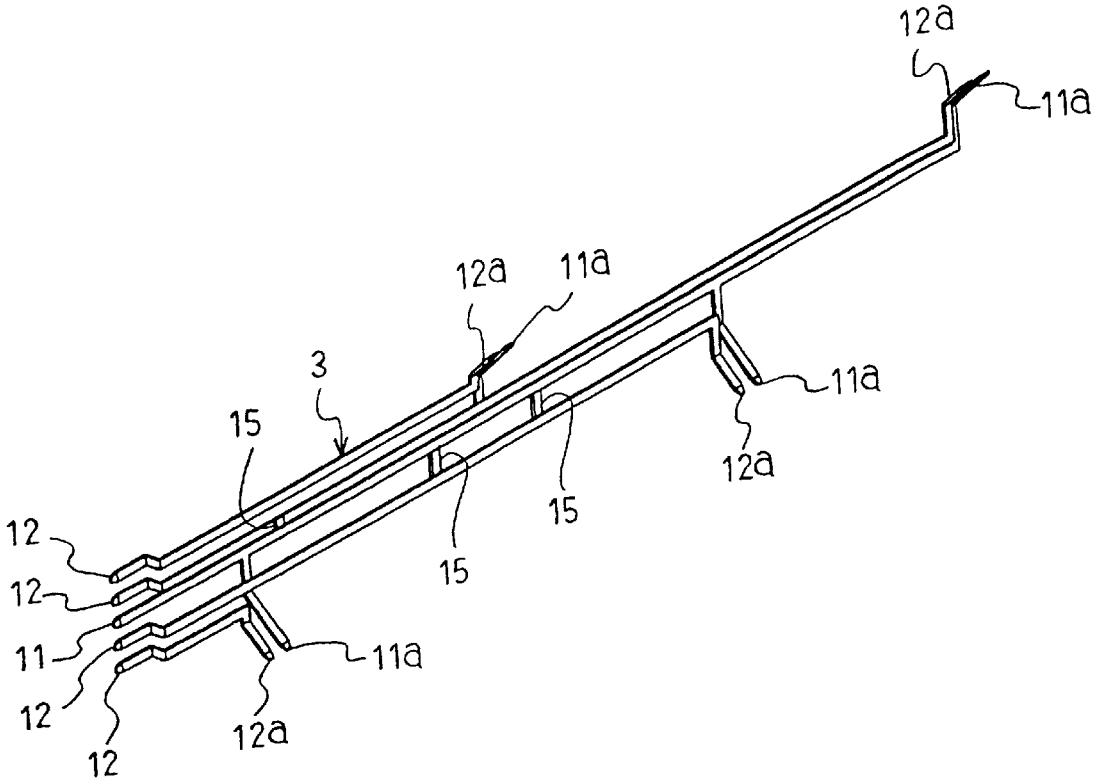
FIG. 1 is a perspective view of an electrical wiring of an engine fuel rail according to the invention.
Figure 2:
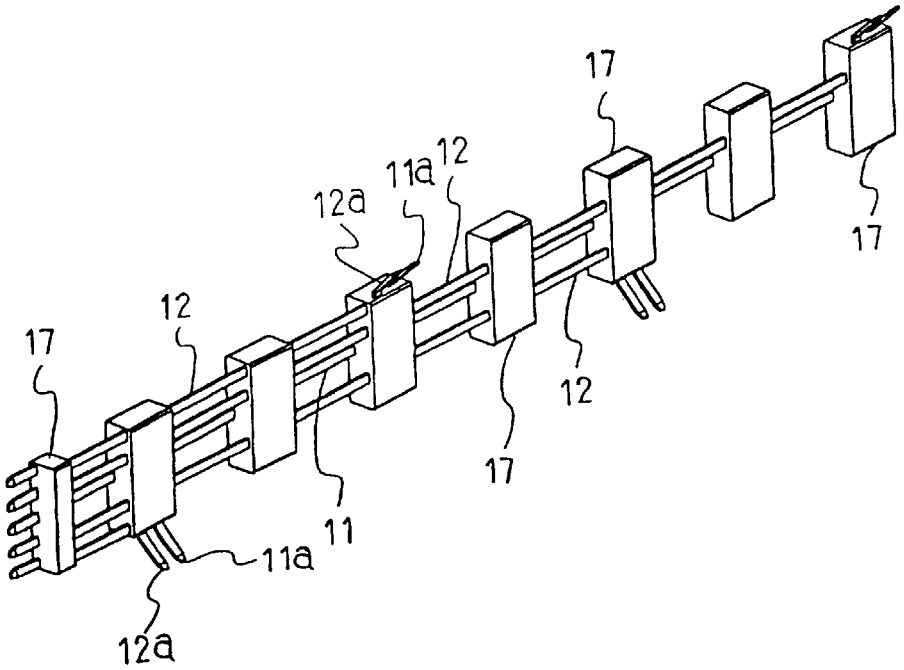
FIG. 2 is a perspective view showing a state wherein the electrical wiring is securely held by reinforcement blocks.

In forming the electrical wiring 3, connection ribs 15 for reinforcement are formed (refer to FIG. 1) in preparation for a succeeding step, and removed by press cutting upon completion of the succeeding step (refer to FIG. 2). As shown in FIG. 2, in the succeeding step, reinforcement blocks 17 for holding the lengths of electrical wires or wiring member 11, 12 running in parallel with each other at given spacings are formed The reinforcement blocks 17 in the aggregate may be molded in a block out of necessity for positioning to prevent deformation occurring at the time of a secondary molding (refer to FIGS. 4 and 5) as the final molding, however, a minimum amount of the synthetic resin is used by providing voids between the respective reinforcement blocks 17 so that any excess in thickness of a final product can be eliminated. For the synthetic resin used in the molding, a thermoplastic resin (for example, PPS) is used.

Figure 3:
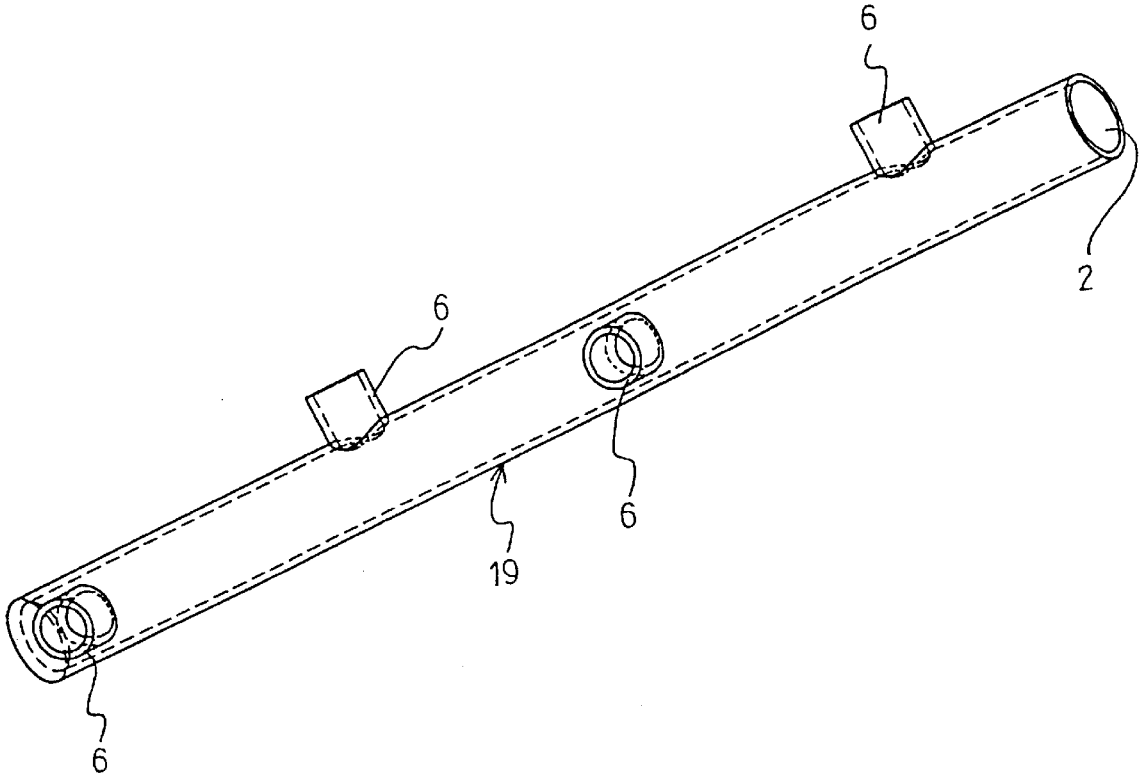
FIG. 3 is a perspective view of an oil delivery pipe of the engine fuel rail according to the invention.

In molding of the oil delivery path 2 alongside the electrical wiring 3, an oil/fuel delivery pipe 19 is molded of the synthetic resin and the fixture mounts 6 for the injectors are integrally molded therewith so as to be protruded therefrom in a step of a primary molding as shown in FIG. 3.

In molding of the final product (refer to FIGS. 4 and 5), the oil delivery pipe 19 fitted with the sockets 7 on the output side, fabricated in the step of the primary molding as described above, and the electrical wiring 3 fitted with the reinforcement blocks 17 are assembled into a mold, thereby executing insert molding with the synthetic resin.

As shown in the figures, the fuel rail F fabricated by molding as described in the foregoing is a component small in size and compact, thereby attaining significant reduction in fabrication cost. Further, a thickness 20 of the fuel rail, provided to a degree not to be contrary to the compactness, together with embedding of the oil delivery pipe 19 therein, has enabled the fuel rail to have a stable shape in terms of strength. In addition, use of two-pronged injectors and omission of the cord have contributed to a safe connection condition without a risk of occurrence of electrical leakage.

What is claimed is:

1. A method of fabricating an engine fuel rail comprising the steps of:

integrally molding a fuel delivery pipe from a synthetic resin by means of a primary molding, the fuel delivery pipe being provided with a plurality of openings to serve as fixture mounts for respective injectors, the openings being branched from a fuel delivery path disposed on the right side and the left side of the fuel delivery path, alternatively;

forming an electrical wiring by applying press working to a metal sheet;

securely holding the electrical wiring with a plurality of reinforcement blocks by insert molding with synthetic resin; and molding the fuel delivery pipe integrally with the electrical wiring in a base member of the engine fuel rail with synthetic resin by means of a secondary molding, whereby the base member is provided with an opening at one end thereof to serve as a socket on an input side for the electrical wiring, and is provided with a plurality of branching blocks formed integrally therewith at the side thereof, each branching block having both an opening to serve as the fixture mount for the respective injectors and an opening to serve as a socket on an output side for the electrical wiring.

2. The method of fabricating an engine fuel rail according to claim 1, wherein the plurality of wiring members which are integrally connected with one another by connection ribs are formed at the same time when applying press working to a metal sheet in the step of assembling the electrical wiring, and the connection ribs are removed after the reinforcement blocks for fixing the wiring members with one another are molded.

3. A method of fabricating an engine fuel rail, comprising the steps of:

forming an electrical wiring having a plurality of wiring members;

forming reinforcement blocks spaced along a length of the electrical wiring members, each of the reinforcement blocks being secured to at least two of the wiring members;

molding a fuel delivery pipe provided with a plurality of fixture mounts having openings for respective injectors, said openings being branched from a fuel delivery path;

placing the fuel delivery pipe and the plurality of electrical wiring members with the reinforcement blocks into a mold; and molding the fuel delivery pipe, the reinforcement blocks and the electrical wiring members in the mold to form a fuel rail including a base member;

whereby the base member is provided with an opening at one end thereof to serve as a socket on an input side for the electrical wiring members.

4. The method of fabricating an engine fuel rail according to claim 3, wherein the step of forming an electrical wiring having a plurality of wiring members includes forming connecting ribs between the wiring members, and includes the step of removing the connecting ribs from the plurality of wiring members.

5. The method of fabricating an engine fuel rail according to claim 4, wherein the step of removing the connecting ribs is subsequent to the step of forming reinforcement blocks.

6. The method of fabricating an engine fuel rail according to claim 3, wherein the step of molding the fuel delivery pipe, the reinforcement blocks and the electrical wiring members includes forming a plurality of branching blocks formed integral with the fixture mounts of the fuel delivery pipe.

7. The method of fabricating an engine fuel rail according to claim 6, wherein the branching blocks each include sockets adjacent the fixture mounts for supplying electricity through the respective wiring members to respective injectors.

8. The method of fabricating an engine fuel rail according to claim 3, wherein the step of forming an electrical wiring having a plurality of wiring members includes press working a metal sheet to form the plurality of wiring members, the wiring members being supported by connecting ribs therebetween.

9. The method of fabricating an engine fuel rail according to claim 8, wherein the step of forming reinforcement blocks spaced along a length of the electrical wiring members includes molding the reinforcement blocks to the electrical wiring members, the electrical wiring members running parallel to each other, and the reinforcement blocks being spaced along the length of the wiring members.

10. The method of fabricating an engine fuel rail according to claim 9, including the step of removing the connecting ribs from the plurality of wiring members.

11. The method of fabricating an engine fuel rail according to claim 3, wherein the step of forming reinforcement blocks spaced along a length of the electrical wiring members includes molding the reinforcement blocks to the electrical wiring members, the electrical wiring members running parallel to each other, and the reinforcement blocks being spaced along the length of the wiring members.

* * * * *